US005820407A

United States Patent [19]

Morse et al.

[11] Patent Number: 5,820,407

[45] Date of Patent: Oct. 13, 1998

[54] DIRECTIONAL JUMPER CABLES

[76] Inventors: David M. Morse, 9349 S. State Rd. 129, Cross Plains, Ind. 47017; Frank Fletcher, 38730 Lexington #296, Fremont, Calif. 94536

[21] Appl. No.: 844,879

[22] Filed: Apr. 22, 1997

Related U.S. Application Data

[60] Provisional application No. 60/016,205 Apr. 22, 1996.

[51] Int. Cl.[6] ..... H01R 11/00

[52] U.S. Cl. ..... 439/504

[58] Field of Search ..... 439/504, 489, 439/488, 490; 320/105, 104

[56] References Cited

U.S. PATENT DOCUMENTS

| | | | |
|---|---|---|---|
| 3,267,452 | 8/1966 | Wolf | 439/504 |
| 4,163,134 | 7/1979 | Budrose | 200/157 |
| 4,238,722 | 12/1980 | Ford | 320/25 |
| 4,463,402 | 7/1984 | Cottrell | 361/77 |
| 4,740,740 | 4/1988 | Taranto et al. | 320/26 |
| 4,831,321 | 5/1989 | Cooper | 320/25 |
| 4,840,583 | 6/1989 | Moore | 439/504 |
| 4,938,712 | 7/1990 | Black | 439/504 |
| 5,230,637 | 7/1993 | Weber | 439/504 |

FOREIGN PATENT DOCUMENTS

| | | |
|---|---|---|
| 959762 | 6/1964 | United Kingdom . |
| 1270799 | 4/1972 | United Kingdom . |

*Primary Examiner*—Gary F. Paumen
*Attorney, Agent, or Firm*—Richard C. Litman

[57] ABSTRACT

A set of battery jumper cables for placing a discharged battery parallel with a charged battery in order to increase the amount of electrical energy available to the discharged battery. The battery jumper cables include a pair of conductor cables having at each end disengagable clamp handles for coupling terminals of the charged and discharged batteries. One of the conductor cables includes a half wave rectifier biased to permit an electrical charging current from the positive terminal of the charged battery, but prevent reverse flow and potential damage to automobile computer circuitry. In a preferred embodiment the half wave rectifier is replaceably included in one of the disengagable clamp handles of one of the conductor cables. Alternative embodiments include color coding the conductor cables. Other embodiments also include indicia on a clamp handle indicating the bias of the half wave rectifier.

4 Claims, 2 Drawing Sheets

DIRECTIONAL JUMPER CABLES

CROSS REFERENCS TO RELATED APPLICATIONS

This application claims the benefit of U.S. Provisional patent application Ser. No. 60/016,205 filed on Apr. 22, 1996.

BACKGROUND OF THE INVENTION

1. Field of the Invention

The present invention is a set of jumper battery cables for providing power to a stranded vehicle battery from a rescue vehicle with a charged battery. The present invention prevents polarity reversal and damage to the electronic and computer circuitry of the rescue vehicle. More specifically, the present invention relates to battery cables with a half wave rectifier installed in the cable that connects the positive terminals of the stranded and rescue vehicle batteries. Further, indicia are located on the positive rescue cable clamp handle to indicate correct orientation of the half wave rectifier.

2. Description of the Prior Art

Numerous U.S. and foreign patents address the hazards and risks of incorrectly attaching jumper cables when trying to restart a car with a dead battery, particularly the risk of explosion or short. A spark in proximity to exposed battery gases, or a short circuit can cause a catastrophic battery explosion, personal injury and property damage.

Nowadays however, the consumer is becoming more and more sophisticated and aware of these risks, and consequently what was once a certainty, is no longer so. The prior art solved a problem based on the assumption that vehicle owners did not know how to connect battery cables. This no longer the case; the information age has rendered the prior art obsolete. Media such as the Internet, television and radio programs, such as the National Public Radio show Car Talk®, has contributed to consumer education. Today it is unusual for a car owner not to know how to correctly jump start a car. Further combining this degree of consumer awareness with the fact that new jumper cables come with permanently affixed detailed instructions, the accidents that the prior art attempted to resolve, are now rare indeed.

However, consumer education has not, nor has the current art, addressed the problem that the present invention solves: preventing destruction and damage to electronic and vehicle computer circuitry in the event of a reverse current flow when the battery cables are correctly attached between the stranded battery and the rescue battery.

Furthermore, the present invention provides protection (i.e., prevents cross polarity) even if the cables are incorrectly attached, meaning with the rectifier biased from the disabled vehicle rather than to the disabled vehicle. of particular interest to the present invention is U.S. Pat. No. 4,831,321 issued to Robert Cooper on May 16, 1989, which describes a trickle jumping charging device. This device includes a polarity limiting diode in line with a current limiting resistor. The diode is specifically included to prevent damage to a recharging battery in the event a jumper cable is improperly connected (when a cable leads from a positive battery terminal to a negative terminal), thereby causing a reversal of polarity and a short. First, the Cooper patent teaches the use of a diode in conjunction, and in series, with a resistor. Second, the Cooper patent does not teach or describe that a diode alone can be utilized to prevent polarity reversal when battery cables are correctly attached. Conversely, the present invention not only utilizes a half wave rectifier without a resistor to prevent reverse current flow, but does so in a situation when a recharging battery is correctly connected, that is, when a cable connects both positive battery terminals.

Also of interest, U.S. Pat. No. 4,463,402 issued to Gerald G. Cottrell on Jul. 31, 1984, describes a safety jumper cable apparatus with a forward biased silicon controlled rectifier (SCR) connected to a gating circuit that includes a photoelectric triac; the photoelectric triac is triggered by a light emitting diode (LED). The LED is turned on only when the polarity is correct, i.e., the cables are correctly connected. The LED triggers the photoelectric triac, thus causing a signal to turn on the SCR. Although this device does provide reverse polarity protection and short circuit protection, the present invention achieves similar results with fewer components and at greater cost savings.

Several patents describe jumper cables that include diodes as part of their circuitry; however, the circuitry described does not include a half wave rectifier that is in series with the positive terminals of batteries on rescue and stranded vehicles. For instance, U.S. Pat. No. 4,163,134 issued to Charles R. Budrose on Jul. 31, 1979, describes safety jumper cables that prevent possible sparking and the consequential risk of a battery explosion. This objective is accomplished with an on/off switch that is located on the cables at a safe distance from the batteries. Using this device, with the switch in the off position, the user first attaches the cables to the positive terminals. The switch, which is located away from any possible hydrogen source, is then turned on. The electronic circuitry provides for rectifiers that bridge the cables. None though, are in series on a single cable that connects the two positive battery terminals. The complexity of this device alone teaches away from the simple elegant solution that the present invention provides.

Similarly, U.S. Pat. No. 4,238,722 issued to Jimmie R. Ford on Dec. 9, 1980, describes battery safety jumper cables with diodes used in connection with transistors and scolen, ids to provide a system that permits current flow only when the cables are correctly attached However, there are no diodes in series between positive terminals of rescue and stranded batteries that would prevent a reverse polarity. With similar functional limitations, U.S. Pat. No. 4,740,740 issued to James Taranto et al. on Apr. 26, 1988, also describes an apparatus and method for the automatic connection of battery cables. The complex circuitry of this device provides for proper cable polarity no matter how the cables are connected. However, no diodes are serially mounted on a jumper cable that connects the positive battery terminals. And again, U.S. Pat. No. 5,230,637 issued to William P. Weber on Jul. 27, 1993, describes a battery jumper cable with a circuit breaker with diodes connected to a lamp for indicating polarity. The circuitry as described does not provide for diodes to be serially mounted on a jumper cable that connects the positive battery terminals.

Further, British Patent Specification 1,270,799 published by Antony P. Royle and Reginald Ball on Apr. 12, 1972, describes another device for insuring correct battery cable connections. In the event that the cables are correctly positioned, a diode permits the energizing of an electromagnet which in turn closes a contact thus providing a complete circuit. As with previously mentioned patents, no diode is serially mounted on the jumper cable that connects the positive battery terminals.

Some devices utilize diode circuitry in devices that function only to indicate correct polarity. U.S. Pat. No. 4,840,583 issued to Donald M. Moore on Jun. 20, 1989, describes automatic jumper cables which include a light emitting diode for indicating appropriate polarity, and as configured, provides no protection against polarity reversal or shorts.

Finally, British Patent Specification 959,762 published by Joseph A. Mas on Jun. 3, 1964, describes an improved battery charger. Although diodes are used in the device, there are no diodes in any element considered analogous to battery cables. Thus, this reference is only indirectly pertinent to the present invention.

None of the above inventions and patents, taken either singly or in combination, is seen to describe the instant invention as claimed.

SUMMARY OF THE INVENTION

The present invention eliminates the need for costly and complex electronically configured jumper cables. Further, consumer awareness and instructive labeling has rendered the prior art obsolete. Battery cables no longer need to be made with intricate electronic circuitry to safeguard the uninformed consumer. Until the present invention, the art has not kept pace with changing needs. Specifically, the prior art does not offer an inexpensive and cost effective, easily repairable device that provides protection against reverse electrical current flow when battery cables are correctly attached. Also, the present invention provides protection (i.e., prevents cross polarity) even if the cables are incorrectly attached, meaning with the rectifier biased from a disabled vehicle rather than to a disabled vehicle. This is a feature not taught or suggested in the prior art. Reverse current flow is likely in several situations. For example, as a vehicle operator attempts to start a stranded car with a faulty voltage regulator while jumper cables are attached to a rescue vehicle, an excess current can flow back to the positive terminal of the rescue vehicle battery. The unregulated current can destroy a rescue vehicle's computer circuitry.

In fact, nowadays automobiles are relying more and more on sophisticated computer circuitry, and damage is becoming frequent. The present invention is an inexpensive and elegantly simple device specifically configured to alleviate a major and heretofore unrecognized and unresolved problem of damage to a rescue vehicle's electronic circuitry from reverse electric flow when battery cables are correctly attached.

The present device is a pair of insulated 12 to 20 foot cables, each having clamp handles for attachment to battery terminals. Further, each cable has indicia for indicating whether the cable connects positive or negative terminals. Included in the positive cable is an industrial half wave rectifier biased such that when the cable is properly mounted a reverse electrical flow from a stranded vehicle battery is impossible. Upon one of the clamp handles of the positive cable is indicia for indicating the proper forward bias of the half wave rectifier. In the preferred embodiment of the invention, the half wave rectifier is located in one of the clamp handles of the positive cable. Further, the half wave rectifier is of the snap-on type so that, in the event that the half wave rectifier is damaged, it can easily be replaced. The half wave rectifier is preferably an NTE® brand No. 6154, rated with a PRV 400 v and IFV 150 amp., and having a surge rating of 2100 amps.

Accordingly, it is a principal object of the invention to provide a repairable set of battery cables that includes a half wave rectifier for preventing reverse current flow and consequential damage to a rescue vehicle's electronic and computer circuitry.

It is another object of the invention to provide a set of battery cables with a half wave rectifier with color coded cables for indicating a positive cable and a negative cable. Further, on the clamp handle of one of the positive cables are indicia for indicating the forward bias of the half wave rectifier.

It is a further object of the invention to provide a set of battery jumper cables in which the half wave rectifier is replaceable and located in a clamp handle of a positive cable.

Still it is another object of the invention to provide a set of battery jumper cables in which the replaceable half wave rectifier is rated PRV 400 v and IFV 150 amp., and having a surge rating of 2100 amps.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
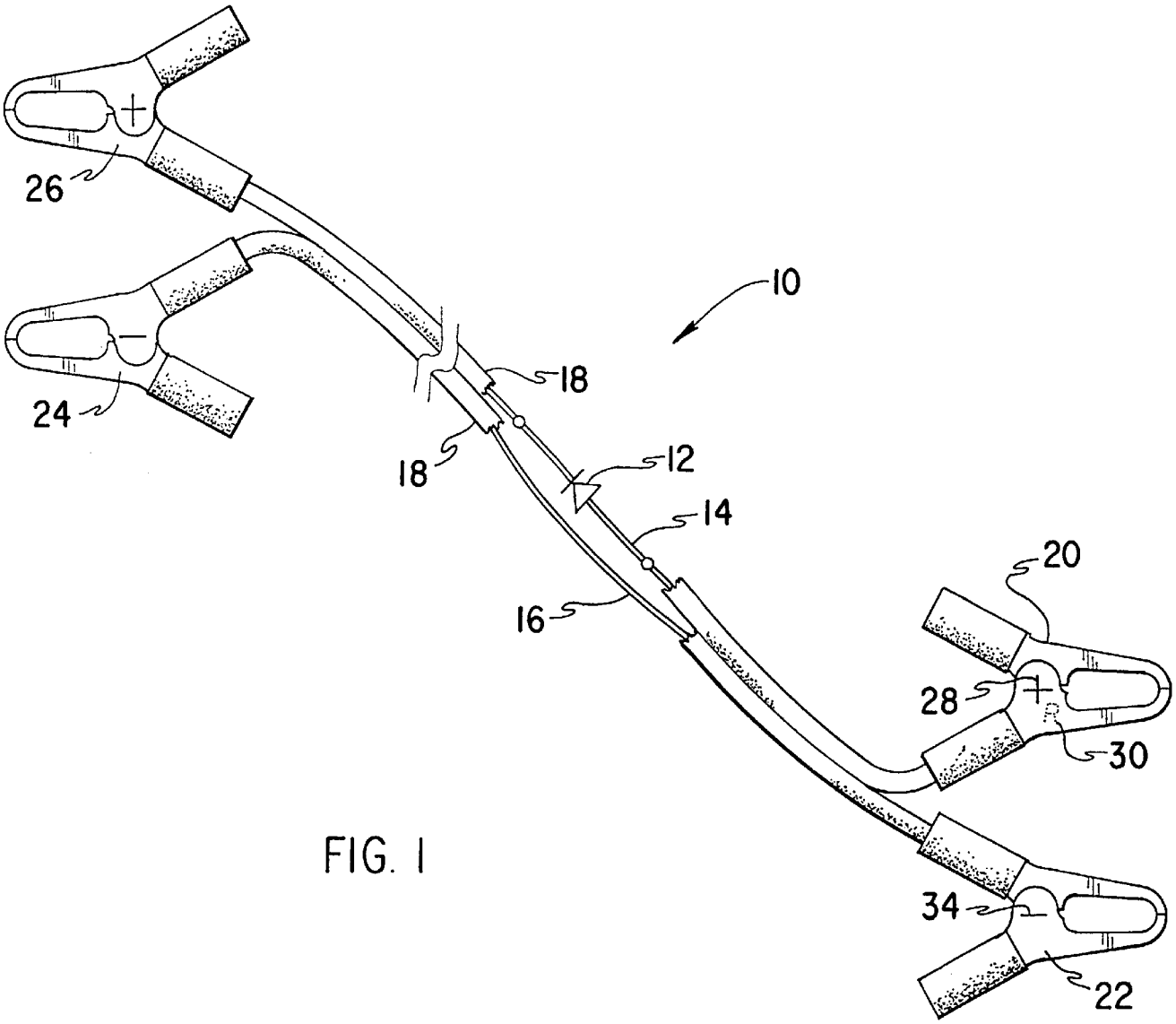
FIG. 1 is a side view of the jumper cable device with a cut away view showing a diagram of the electronic circuit.

FIG. 1 shows a battery jumper cable device 10 which has a pair of conductive cables 14, 16 which may be of stranded copper wire of 10 gauge for heavy duty high strength current carrying capacity. The cables 14, 16 are reasonably long, such as between approximately 12 and 20 feet. Each of these cables 14, 16 is suitably covered with a non-conductive insulating sheath or cover 18, and the two sheaths or covers 18 may be secured together throughout most of their length. A first cable 14 provides conduction of a positive charge and a second cable 16 provides conduction of a negative charge. The cable covers 18 are preferably color coded with a red positive cable covering and a black negative cable covering to assist the user in obtaining proper connections. Each cable end includes a conductively attached clamp handle 20, 22, 24, 26 for attaching the cables on battery terminals 44, 46, 48, 50 (shown in FIG. 3) of a rescue vehicle battery 40 and a stranded vehicle battery 42.

Figure 2:
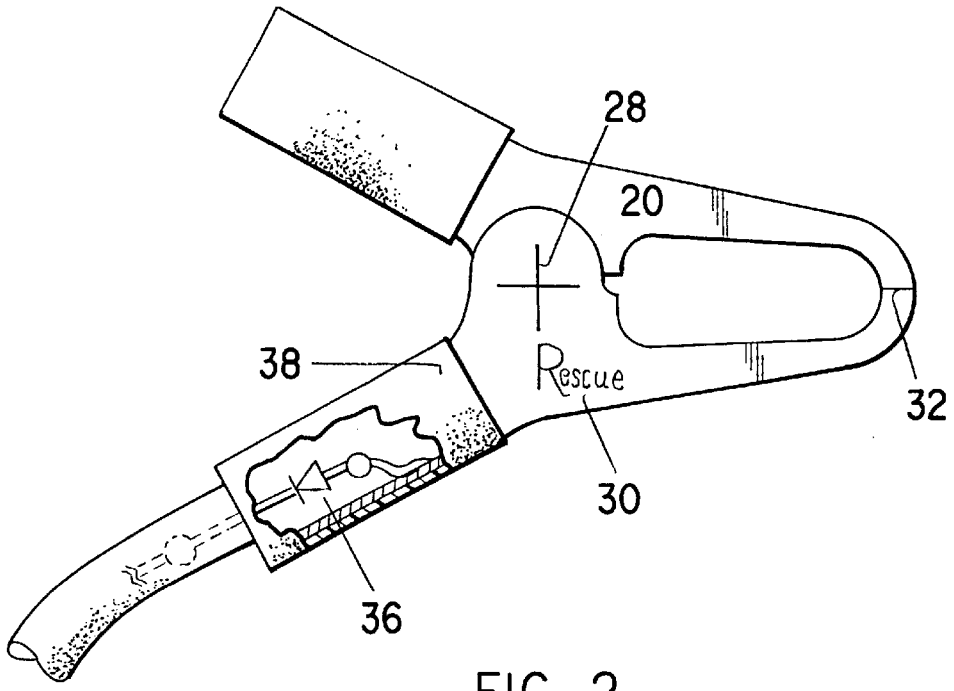
FIG. 2 is a side elevation view of a clamp handle with a portion of the handle cutaway to reveal interior detail, so as to show the half wave rectifier circuitry placed within the handle.
Figure 3:
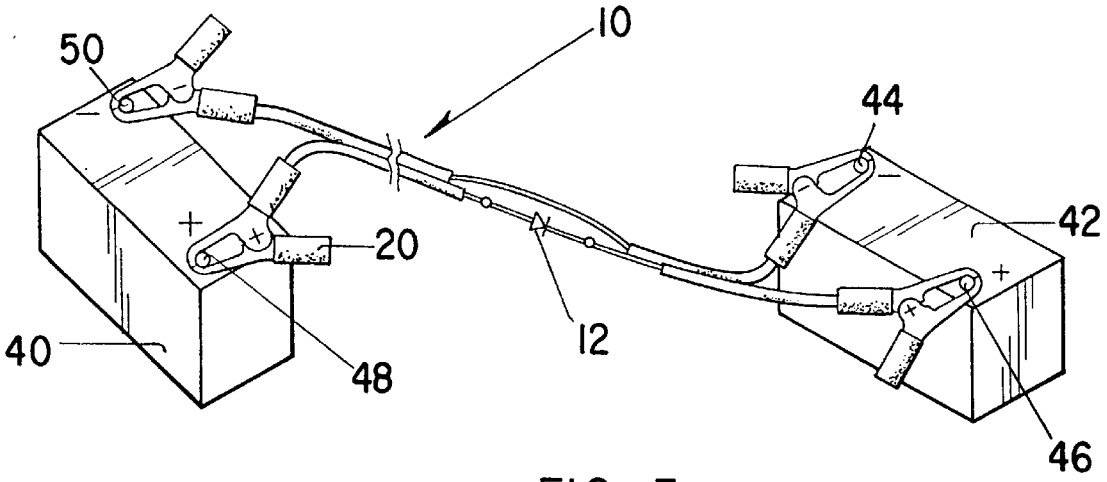
FIG. 3 is a perspective view of the jumper cables showing the proper bias of the positive cable with the half wave rectifier vis-a-vis the rescue vehicle battery.

The cable 14 includes an electrical current restrictor in the form of a half wave rectifier for preventing reverse current flow while a user attempts to restart a stranded vehicle. The half wave rectifier 12 can be positioned within the positive conductive cable 14, as shown in FIGS. 1 and 3. However, a preferable arrangement is shown in FIG. 2, where a replaceable snap type half wave rectifier 36 is positioned within the handle 38 of the positive clamp handle 20. The half wave rectifier is preferably an NTE® brand No. 6154, rated with a PR7 400 v and IFV 150 amp., and having a surge rating of 2100 amps.

Upon each clamp handle are indicia for indicating whether the clamp handle should be attached to a positive battery terminal 46, 48 or to a negative battery terminal 44, 50. Preferably a "+" sign 28 is included on the positive clamp handles 20, 26, arid a "−" sign 34 is included on the negative clamp handles 22, 24. On the clamp handle 20 of the positive cable 14, which is intended to be placed on the positive battery terminal, is indicia 30 for properly orienting the bias of the half wave rectifier. Preferably the clamp handle 20 has the letters "rescue" 30 indicating that the clamp handle 20 should be placed on the positive terminal 48 of the battery 40 of the rescue vehicle.

It is to be understood that the present invention is not limited to the embodiments described above, but encompasses any and all embodiments within the scope of the following claims.

We claim:

1. A directional automobile jumper cable device for connecting positive and negative battery terminals of a stranded vehicle battery and a rescue vehicle battery, comprising:

a first electrical conductive cable having a first and second end, and a second electrical conductive cable having a third and fourth end;

a first and second clamp handle means conductively affixed to said first and second ends for attaching said first cable to the positive battery terminals of the stranded vehicle battery and the rescue vehicle battery;

a third and fourth clamp handle means conductively affixed to said third and fourth ends of said second cable for attaching said second cable to the negative terminals of the stranded vehicle battery and the rescue vehicle battery; and, said first cable having a single half wave rectifer for preventing a positive electrical current flowing from the stranded vehicle battery to the rescue vehicle battery.

2. A directional automobile jumper cable device according to claim 1, wherein said half wave rectifier is housed in said first clamp handle means and said first clamp handle means includes indicia for properly orienting the bias of the half wave rectifier.

3. A directional automobile jumper cable device according to claim 1, wherein;

said first conductive cable has a non-conductive insulating red cover and said second conductive cable has a non-conductive insulating black cover.

4. A directional automobile jumper cable device for connecting positive and negative battery terminals of a stranded vehicle battery and a rescue vehicle battery, consisting of:

a first electrical conductive cable having a first and second end and a non-conductive insulating red covering, and a second electrical conductive cable having a third and fourth end and a non-conductive insulating black covering;

a first and second clamp handle means conductively affixed to said first and second end for attaching said first cable to the positive battery terminals of the stranded vehicle battery and the rescue vehicle battery;

a third and fourth clamp handle means conductively affixed to said third and fourth ends for attaching said second cable to the negative terminals of the stranded vehicle battery and the rescue vehicle battery;

a single half wave rectifier serially connected in said first clamp handle means, said half wave rectifier preventing a positive electrical current flow from the stranded vehicle battery to the rescue vehicle battery; and, said first clamp handle means having indicia for properly orienting the bias of the half wave rectifier.

* * * * *